United States Patent [19]

Smith

[11] Patent Number: 4,691,612

[45] Date of Patent: Sep. 8, 1987

[54] ACCESSORY FOR A DRUM PEDAL ASSEMBLY

[76] Inventor: Peter L. Smith, 36 Tahattawan Rd., P.O. Box 443, Littleton, Mass. 01460

[21] Appl. No.: 942,801

[22] Filed: Dec. 17, 1986

Related U.S. Application Data

[63] Continuation-in-part of Ser. No. 789,133, Oct. 18, 1985, abandoned.

[51] Int. Cl.[4] ..... G10D 13/02

[52] U.S. Cl. ..... 84/422 R; 84/453

[58] Field of Search ..... 84/422 R–422 S, 84/453

[56] References Cited

U.S. PATENT DOCUMENTS

| | | | |
|---|---|---|---|
| 1,343,164 | 6/1920 | Smith | 84/422 R |
| 1,386,605 | 8/1921 | Danly | 84/422 C |
| 3,439,574 | 4/1969 | Ramsey | 84/422 R |
| 3,930,431 | 1/1976 | Magadini | 84/422 R |
| 3,998,123 | 12/1976 | Hinger | 84/422 S |

FOREIGN PATENT DOCUMENTS

| | | | |
|---|---|---|---|
| 265680 | 2/1927 | United Kingdom | 84/422 C |

*Primary Examiner*—Lawrence R. Franklin

[57] ABSTRACT

An accessory for a drum pedal assembly is disclosed which adjusts the distribution of weight acting on the rotatory element whereby the balance point of the stroke of the beater element as well as rotational forces influencing the character of the beater stroke may be altered. The means for adjustment comprise a cylindrical weight with a rod extending axially which is rotatively carried by a beater stem mount to which it is adjustably secured. By adjusting the extention and orientation of the cylindrical weight, the attack, response and swing of the beater is affected thereby overcoming inherent problems found in the prior art.

13 Claims, 7 Drawing Figures

ACCESSORY FOR A DRUM PEDAL ASSEMBLY

This application is a continuation-in-part of application Ser. No. 789,133, filed on Oct. 18, 1985, now abandoned.

TECHNICAL FIELD

The present invention relates to a pedal assembly used to strike a drum and more particularly, to an accessory used on such a drum pedal assembly characterized in means of adjustment.

BACKGROUND ART

The prior art has provided a wide variety of drum pedal assemblies. Generally, these pedal assemblies comprise a frame element clamped to a drum hoop, a rotatory element provided by the frame element, a pedal element secured to the frame element and connected to the rotatory element by a linkage element and a cam element, a retraction element secured to the rotatory element and a beater element adjustably secured to the rotatory element by a beater mount thereon. All these elements work together for the purpose of axially rotating the beater element in and out of a strike position whereby a drum head is actuated.

Due to the wide range of musical styles, techniques and personal needs, the prior art has provided means to make drum pedal assemblies adjustable. However, although these adjustments are vital, they are crude and limited due to inherent problems.

One adjustment offered by the prior art is that of beater extension which adjusts the radial distance between the head of the beater element and the axis of the rotatory element whereby the arc circumference of the beater stroke as well as the inertia and torque acting on the beater element is affected. This adjustment is provided by the beater mount and is accomplished by securing the beater element at different points along the length of the stem.

The problem with this adjustment is that by increasing beater extension, the increase in arc circumference, inertia and torque results in a loss of speed but an increase of power and swing due to added momentum. Likewise, by decreasing beater extension, the decrease in arc circumference, inertia and torque results in an increase of speed but a loss of power and swing due to reduced momentum. For these reasons, it is difficult to achieve a satisfying combination of speed, power and swing.

Another adjustment offered by the prior art is that of beater angle which adjusts the stroking distance or throw of the beater element. This adjustment is accomplished by adjusting either the position of the beater mount or the rest position of the rotatory element by means of the retraction element.

The problem with this adjustment is that when the beater angle is adjusted to provide a longer stroke, the increased stroking distance results in an increased degree of resistance by the retraction element when the beater reaches strike position. This problem requires additional applied pressure to the pedal element in order to compensate.

One other adjustment offered by the prior art is that of the retraction element which comprises a biasing spring eccentrically secured to the rotatory element. This adjustment is accomplished by adjusting the torque of the biasing spring whereby the attack and response of the beater element is affected.

The problem with this adjustment is that by increasing the torque of the biasing spring to acquire a quicker attack and response there is added resistance to the pedal element. This problem also requires additional applied pressure to the pedal element in order to compensate.

Due to these inherent problems found in the prior art and in answer to the need for improvement, the present invention is now disclosed.

DISCLOSURE OF THE INVENTION

The principal object of the present invention is to provide means of adjustment whereby the stroking distance, attack and response of the beater element may be affected without adjusting the angle of the beater element or the torque of the biasing spring.

Another object of the present invention is to provide means of adjustment whereby a satisfying combination of speed, power and swing may be achieved.

It will further be an object of the present invention to provide means of adjustment whereby the downward torque of the pedal element and biasing spring on the rotatory element may be equalized for the purpose of providing a full and even swing to the beater element.

In addition, it will be an object of the present invention to provide means of adjustment which will be adaptable to any drum pedal assembly.

In accordance with the present invention, means of adjustment comprise a cylindrical weight with a rod extending axially. The weight is carried by a beater stem mount to which the rod portion is adjustably secured by means comprising perpendicular, intersecting bore holes which can receive the extension rod in alternative, perpendicular orientations. By adjusting the extension and orientation of the cylindrical weight, the distribution of weight acting on the rotatory element is altered to affect the balance point of the stroke of the beater element as well as rotational forces influencing the character of the beater stroke.

BEST MODE FOR CARRYING OUT THE INVENTION

It is to be understood that the balance point of the stroke of the beater element is that point at which the beater neither falls forward (toward the drum) nor backward (away from the drum). This point is best determined by releasing the torque of the biasing spring and rotating the beater until it balances.

A description of the preferred embodiment of the present invention is now given referring to FIGS. 1 thru 6.

Figure 1:
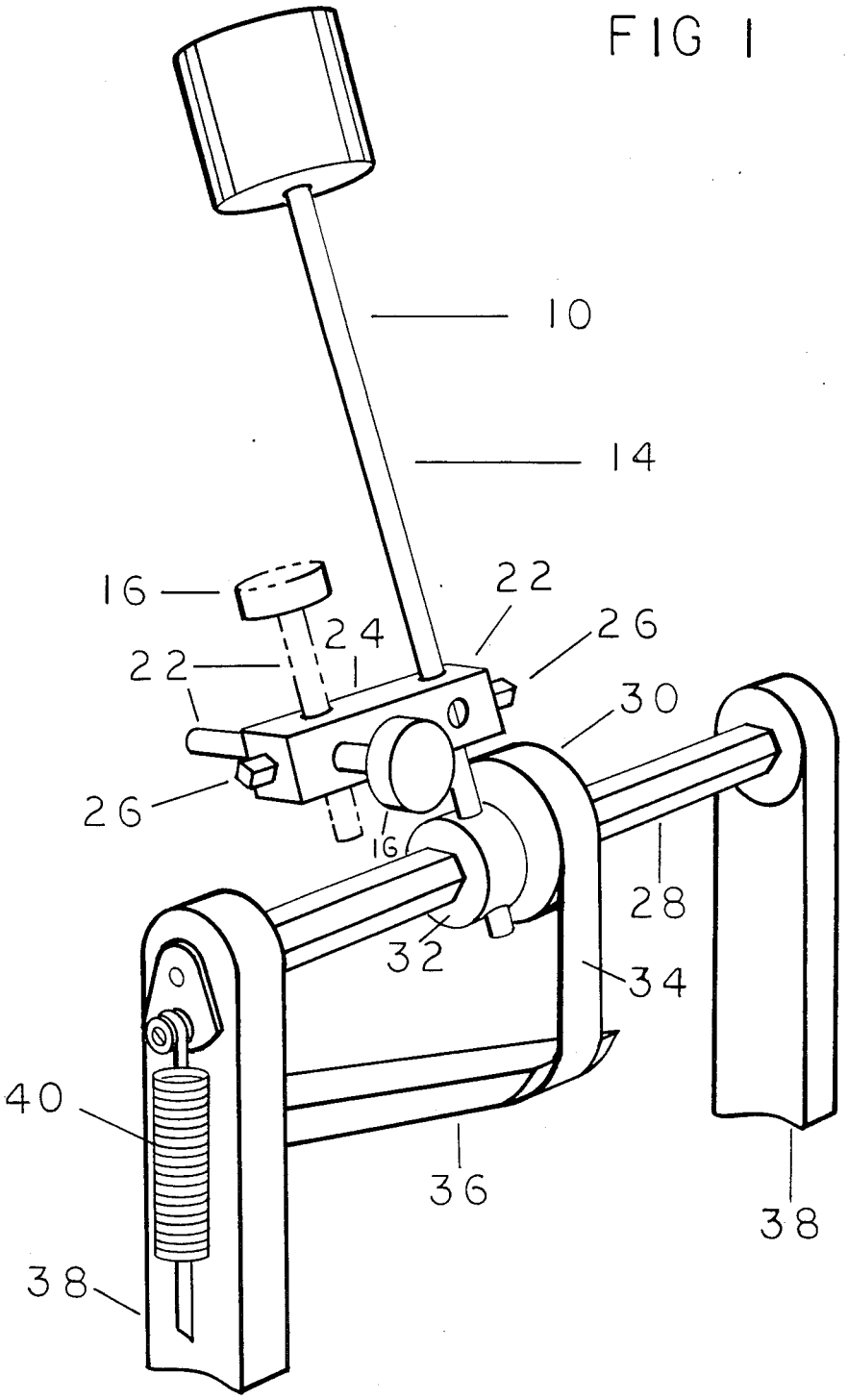
FIG. 1, is a perspective view of the present invention showing the preferred embodiment positioned on a drum pedal assembly with an alternate orientation shown in phantom.
Figure 2:
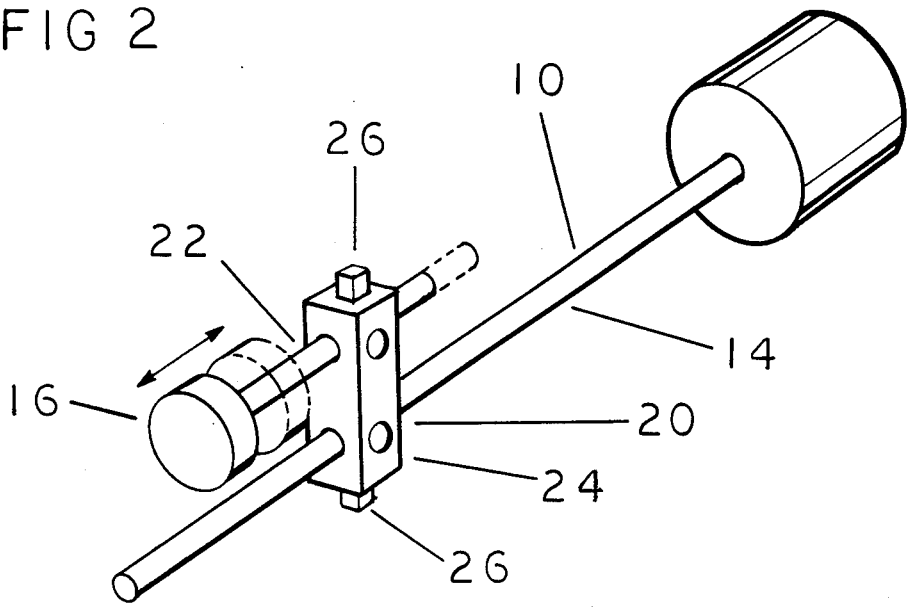
FIG. 2 is a perspective view of the present invention showing the preferred embodiment of the beater stem mount and adjustment of the weight in phantom.

FIG. 1 illustrates a perspective view of a conventional drum pedal assembly comprising a frame element 38, a rotatory element 28 provided by the frame element 38, a pedal element 36 secured to the back of the frame element 38 and connected to the rotatory element 28 by a linkage 34 and a cam element 30, a biasing spring 40 and a beater element 10 adjustably secured to the rotatory element 28 by a beater mount 32 thereon.

By depressing the pedal element 36, torque is applied to the rotatory element 28 via the linkage 34 and cam element 30 thereby overcoming the torque and inertia of the beater element 10 and the biasing spring 40. This causes the beater element 10 to rotate into a strike position whereby the drum head is actuated. Likewise, by releasing the pedal element 36,the torque of the biasing spring 40 and the beater element 10 causes the beater to swing out of the strike position and into an eventual rest position.

FIG. 1 further illustrates means to adjust the distribution of weight acting on the rotatory element 28 comprising a weight 16 adjustably secured to a beater stem mount 20 by an extension rod 22.

Preferably, the weight 16 is a short cylindrical steel piece with a diameter no greater than one inch. The cylindrical weight 16 is integrated with a rod 22 which extends axially. As shown in phantom in FIG. 2, the rod 22 allows the extension of the cylindrical weight 16 to be slidably adjusted. The more the weight 16 is extended the more it is radially distant from the axis of the rotatory element 28. This adjustment affects the degree of rotational forces acting on the weight 16 as it is rotatively carried by the beater stem mount 20.

The preferred embodiment of the beater stem mount 20 comprises a light metal block 24 which provides spaced perpendicular, intersecting bore holes with coinciding set screw 26 located at each end. The spacing between the spaced bore holes should be sufficient to allow the weight 16 with extension rod 22 to be received in alternative, perpendicular orientations without obstruction by the beater mount 32 as shown in FIG. 1 in phantom.

The beater stem mount 20 is preferably positioned at the lower end of the beater stem 14 in alignment with the rotatory element 28 where it is securly held by tightening the set screw 26 with a conventional drum key. To explain the ways in which the present invention overcomes inherent problems in the prior art, the four orientations of the weight 16 are discussed referring to FIGS. 3, 4, 5 and 6.

Figure 3:
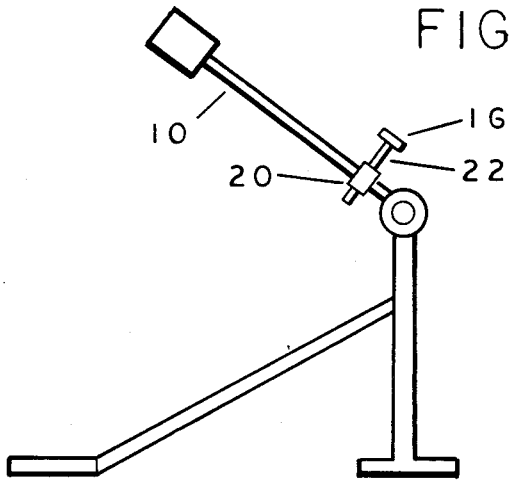
FIG. 3, is a side view of a drum pedal assembly showing the preferred embodiment of the weight in front orientation.

FIG. 3 shows the cylindrical weight 16 oriented at the front side of the axis of the rotatory element 28. In front orientation the weight compliments the torque of the pedal element thus causing the beater element to have a lower balance point. As a result, a greater portion of the beater stroke is in a forward fall position. This causes the beater to have a quicker strike but a slower response as well as a shorter swing distance.

Front position compensates for pedal resistance as a result of the torque by the biasing spring and beater element thereby requiring a lesser degree of pedal pressure and reducing the momentum of the beater element.

Figure 4:
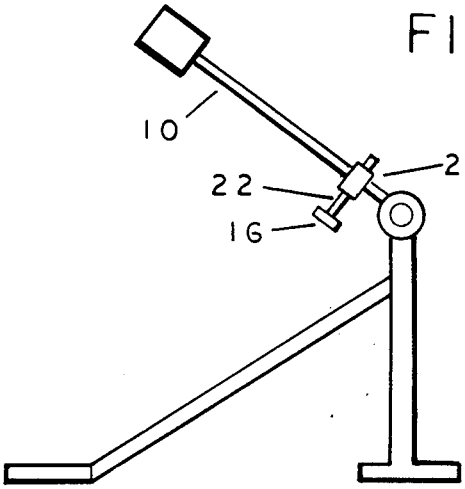
FIG. 4, is a side view of a drum pedal assembly showing the preferred embodiment of the weight in back orientation.

FIG. 4 shows the cylindrical weight 16 oriented at the back side of the axis of the rotatory element 28. In back orientation the weight compliments the torque of the beater element and the biasing spring thus causing the beater to have a higher balance point. As a result, a greater portion of the beater stroke is in a backward fall position. This causes the beater to have a slower strike but a quicker response as well as a longer swing distance.

Back orientation compensates for a loss of torque as a result of a decrease in beater extension thereby allowing a reduced arc circumference for speed without a loss of power. Also, back orientation provides an increase in stroking distance due to an increase in retraction momentum thereby eliminating the need for beater angle adjustment and avoiding increased torque by the biasing spring.

Figure 5:
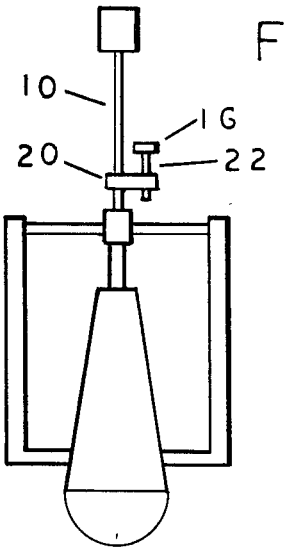
FIG. 5, is a back view of a drum pedal assembly showing the preferred embodiment of the weight in top orientation.
Figure 6:
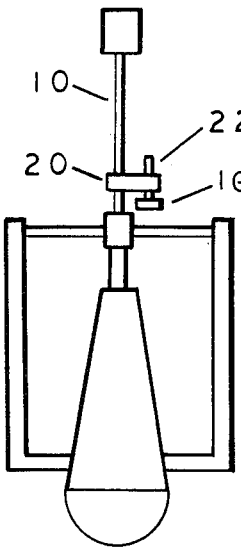
FIG. 6, is a back view of a drum pedal assembly showing the preferred embodiment of the weight in bottom orientation.

FIGS. 5 and 6 show the cylindrical weight 16 at top and bottom orientations parallel to the beater stem. In both of theae orientations the weight will not affect the balance point of the beater element but will affect the distribution of mass along its stem. This results in an even distribution of inertia throughout the beater element which provides a more even stroke. Also, top and bottom orientation allow for the adjustment of centrifugal force acting on the weight 16 whereby a lift is provided to equalize the downward forces of the pedal element and the biasing spring for a fuller beater swing.

The ratio of rotational forces are increased by securing the beater stem mount 20 higher on the beater stem 14 thus increasing the overall distance between the cylindrical weight 16 and the axis of the rotatory element 28. Also, by swiveling the beater stem mount 20 so that it extends to the front or back of the beater element 10, top and bottom orientations can be combined with front and back orientations.

Figure 7:
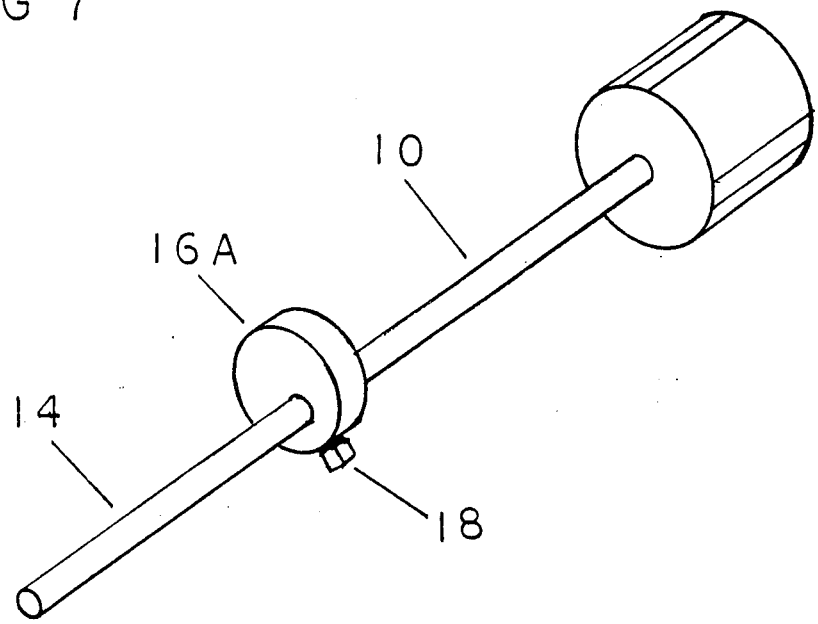
FIG. 7, is a perspective view showing an alternate embodiment for the weight of the present invention.

Due to the adjustability of the beater stem mount 20, subtle alteration of weight distribution may be accomplished by using the beater stem mount 20 without the weight 16 and extension rod 22. For this reason, an alternate embodiment of the present invention is now described referring to FIG. 7.

The alternate means for adjusting the distribution of weight acting on the rotatory element 28 comprises a metal disc 16A provided with an eccentrically positioned bore hole running axially and intersected by a set screw 18. The disc 16A is adjustably secured to the beater stem 14 whereby its mass may be oriented at the front or back of the beater element 10 by means of swivel adjustment.

It is to be understood that the present invention is not limited to the precise construction herein described and illustrated in the accompanying drawings. Numerous modifications and variations are possible without departing from the spirit of the invention. For example:

1. One of the perpendicular, intersecting bore holes serving to secure the beater stem mount to the beater stem may be of a greater diameter to accommodate a beater stem of larger demension.

2. Rather than two intersecting bore holes, three bore holes can be intersected by fashioning the beater stem mount from hexagonal material.

3. The extension rod 22 may be used without the weight 16 to slidably adjust weight distribution.

4. Rather than being cylindrical, the weight 16 may be of any shape i.e., hexagonal, spherical or square.

5. Rather than a beater stem mount, the weight 16 with extension rod 22 may be rotatively carried by a mount secured to the rotatory element 28 which provides means to adjustably secure the extension rod 22. Also, the cam element may be modified for this purpose.

6. Rather than a beater stem mount, the weight 16 may be rotatively carried by a mount secured to the rotatory element 28 which provides means to adjustably secure the weight 16. Also, the cam element may be modified for this purpose i.e., a plurality of holes along the periphery of the cam to which the weight 16 is alternatively secured by suitable means.

Due to the number of variations, it is intended that the present invention be considered as broadly as permitted by the appended claims.

What is claimed is:

1. a drum pedal assembly having a drum beater element secured to a pedal actuated rotatory element, means to adjust the distribution of weight acting on the rotatory element comprising:

(A) a metal weight with straight parallel sides;

(B) a mount means to rotatively carry said metal weight;

(C) means to adjustably secure said metal weight to said mounted means; and (D) means to secure said mount means to either said rotatory element of said beater element, whereby adjustment of said metal weight affects the balance point of the stroke of the beater element as well as the rotational forces influencing the character of the stroke of said beater element.

2. A means to adjust as described in claim 1 wherein said means to adjustably secure said metal weight to said mount means comprises an extension rod extending from said metal weight, said mount means providing a means to adjustably secure said extension rod whereby said metal weight is adjustably oriented.

3. A means to adjust as described in claim 2, wherein said metal weight is cylindrical, said rod to extend axially from said cylindrical metal weight.

4. A means to adjust as described in claim 3, wherein said means to adjustably secure said extension rod comprise intersecting bore holes with a coinciding set screw.

5. A means to adjust as described in claim 4, wherein said bore holes are perpendicular, said perpendicular, intersecting bore holes receiving said rod extending axially from said cylindrical metal weight in alternative, perpendicular orientations.

6. A means to adjust as described in claim 5, wherein said mount means comprise a beater stem mount which provides spaced perpendicular bore holes with coinciding set screws located at each end.

7. A drum pedal assembly including a pedal actuated beater element, means to adjust the distribution of weight acting on said beater element comprising:

(A) a metal weight with straight parallel sides;

(B) a beater stem mount to rotatively carry said metal weight;

(C) means to adjustably secure said metal weight to said beater stem mount; and (D) means to adjustably secure said mount means to said beater element, whereby adjustment of said metal weight affects the balance point of the stroke of the beater element as well as the rotational forces influencing the character of the stroke of the beater element.

8. A means to adjust as described in claim 7, wherein said means to adjustably secure said metal weight to said beater stem mount comprises a rod extending from said metal weight, said beater stem mount providing means to adjustably secure said rod whereby said metal weight is adjustably oriented.

9. A means to adjust as described in claim 8, wherein said metal weight is cylindrical, said rod extending axially from said cylindrical metal weight.

10. A means to adjust as described in claim 9, wherein said means to adjustably secure said rod comprises bore holes with a coinciding set screw.

11. A means to adjust as described in claim 10, wherein said bore holes are perpendicular and intersect, said perpendicular, intersecting bore holes receiving said rod extending axially from said cylindrical metal weight in alternative, perpendicular orientations.

12. A means to adjust as described in claim 11, wherein said beater stem mount comprises a metal block which provides spaced perpendicular, intersecting bore holes with coinciding set screws located at each end.

13. A drum pedal assembly wherein a cylindrical metal weight eccentrically secured to the stem of the beater element comprises a metal disc provided with an eccentrically positioned bore hole running axially and intersected by a set screw, said metal disc adjusting the distribution of weight acting on the rotatory element by means of swivel adjustment whereby the balance point of the stroke of said beater element as well as the rotational forces influencing the character of the stroke of said beater element are affected.

* * * * *